United States Patent [19]

Biehl

[11] Patent Number: 4,619,379

[45] Date of Patent: Oct. 28, 1986

[54] BULK FOOD DISPENSER

[76] Inventor: Roy J. Biehl, 1133 N. Water St., Milwaukee, Wis. 53202

[21] Appl. No.: 646,650

[22] Filed: Aug. 30, 1984

[51] Int. Cl.[4] ..... B67D 5/32

[52] U.S. Cl. ..... 222/153; 222/181; 222/243; 222/325; 222/505; 222/511

[58] Field of Search ..... 222/153, 181, 243, 325, 222/505, 511, 561; 141/326, 386, 391

[56] References Cited

U.S. PATENT DOCUMENTS

| | | | |
|---|---|---|---|
| 1,359,161 | 11/1920 | Gardner | 222/505 |
| 1,751,535 | 3/1930 | Terborg | 222/505 |
| 1,931,908 | 10/1933 | Tillotson | 222/243 |
| 2,410,410 | 11/1946 | Garubo | 222/243 |
| 2,551,765 | 5/1951 | Sedor | 222/511 |
| 2,745,573 | 5/1956 | Fuller | 222/561 |
| 3,344,958 | 10/1967 | Kaaneke | 222/325 |
| 3,938,709 | 2/1976 | Collar | 222/325 |
| 4,351,455 | 9/1982 | Bond | 222/153 |
| 4,440,322 | 4/1984 | Henry | 222/153 |

*Primary Examiner*—H. Grant Skaggs

*Attorney, Agent, or Firm*—Andrus, Sceales, Starke & Sawall

[57] ABSTRACT

A container for dispensing food includes a hopper having an inlet at its top and an outlet at its bottom, a gate slidably mounted on the hopper for opening and closing the outlet, and an actuator handle pivotally mounted on the hopper and engageable with the gate for moving the gate. The gate includes an upstanding projection that agitates the food in the hopper as the gate is moved, and the front wall of the hopper includes a plurality of flexible fingers that operate to meter the flow of food through the outlet. The gate may only be slid to an open position if a latching mechanism is first unlocked.

12 Claims, 11 Drawing Figures

FIG. 3
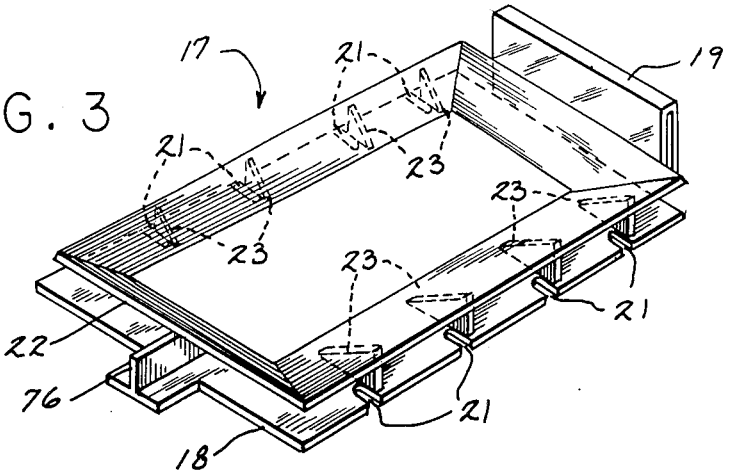
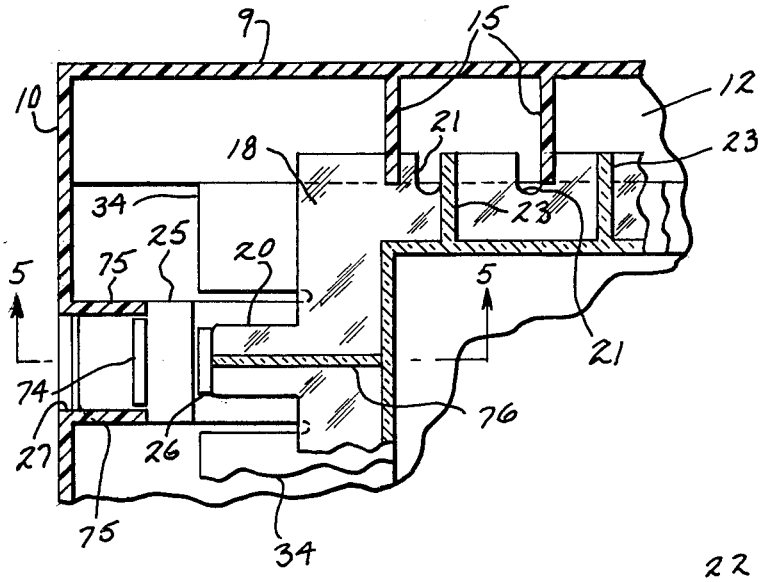
FIG. 4
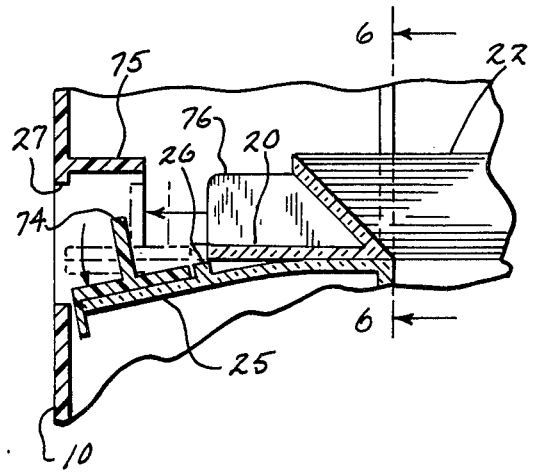
FIG. 5
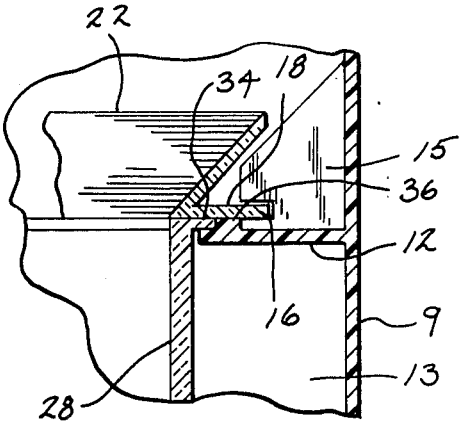
FIG. 6

30
37
38
39
74
26
25
35
32
29
28
63
34
31
77
55
33
56
57
59
61
58
60
48
44
43
40
41
42
46
47
45
50
49
51
54
53
52
69
65
64
70
66
72
71

BULK FOOD DISPENSER

BACKGROUND OF THE INVENTION

The present invention relates to dispensers, and more particularly to a bulk food dispenser.

The food industry merchandizes numerous types of food in bulk form. At present, food products such as flour, beans, rice, pasta, spices, nuts, cake mixes and others are available in bulk form. Customers perceive bulk foods as being fresher and healthier than equivalent packaged foods. Additionally, cost savings to the consumer and the consumer's ability to buy the exact amount needed are reasons for merchandizing food in bulk form.

In the past, buyers at retail supermarkets have merely poured from vats or scooped out from bins the amounts desired. However, the greatest concern about bulk selling is its cleanliness and the threat of human tampering. Such concerns have prompted various governmental agencies to begin regulating the sale of food in open containers.

Various dispensers of bulk foods are known. For example, U.S. Pat. No. 1,751,535 shows a coffee dispenser and U.S. Pat. No. 748,059 shows a feed regulator for a dispenser. Neither of these dispensers, however, are tamper-proof, and the outlet or discharge of both may easily become jammed.

SUMMARY OF THE INVENTION

A dispenser for dispensing bulk food. The dispenser includes a hopper having an inlet and an outlet, adjustable gate means slidably mounted on the hopper for regulating the discharge of food through the outlet, actuator means pivotally mounted on the hopper for moving the gate means, and latch means movable between a locked position preventing movement of the gate means and an unlocked position permitting movement of the gate means.

The gate means is biased toward its closed position, and includes an upright member projecting into the hopper which agitates the food therein as the gate means is moved between its open and closed positions. The upstanding member slides in a slot formed in the bottom wall of the hopper and includes an abutment surface which engages a portion of the bottom wall to function as a stop to limit the opening movement of the gate means to regulate the size of the outlet. The gate means slides in a track formed in a guide member beneath the hopper, and includes a pair of flexible fingers each having an abutment surface that engages a stop member for limiting the closing movement of the gate so that the gate completely closes off the outlet of the hopper. The guide member also includes a spout portion beneath the discharge outlet and projecting from the front of the hopper.

The latch means includes an arm pivotally mounted to the spout of the guide member. The arm is biased to a locked position and includes a hook at its inner end for engaging a corresponding slot formed in the gate means. The forward end of the arm includes a handle extending beneath the spout of the guide member which is engageable by a person in order to pivot the arm and disengage the hook from the groove in the gate means.

A housing completely encloses the hopper and includes an inner flange that receives a corresponding flange around the top edge of the hopper for supporting the hopper in a removable manner for ease of cleaning.

A transparent bin is also supported by the housing and is attached to a collar which in turn is removably mounted within the housing by a catch mechanism.

The dispenser thus provides a mechanism for dispensing foods of various sizes and shapes with the ability to regulate the discharge flow of food without becoming jammed. The dispenser is tamper-proof so that its contents are inaccessible to a customer except by qualified personnel, and provides a safety mechanism to prevent unintended opening. The dispenser may be easily disassembled for cleaning and resealable to maintain freshness of the food. Additionally, the contents are readily visible to a customer so that the customer may see the quality of the product prior to its being dispensed.

BRIEF DESCRIPTION OF THE DRAWINGS

The drawings illustrate the best mode presently contemplated of carrying out the invention.

In the drawings:

FIG. 3 is a perspective view of a collar employed to support the transparent bin shown in FIG. 1;

FIG. 4 is a fragmentary cross-sectional view taken along the plane of the line 4—4 in FIG. 2;

FIG. 5 is a fragmentary cross-sectional view taken along the plane of the line 5—5 in FIG. 4 illustrating the operation of the catch mechanism for holding the collar of FIG. 3 in position;

FIG. 6 is a fragmentary cross-sectional view taken along the plane of the line 6—6 in FIG. 5;

DESCRIPTION OF THE PREFERRED EMBODIMENT

Figure 1:
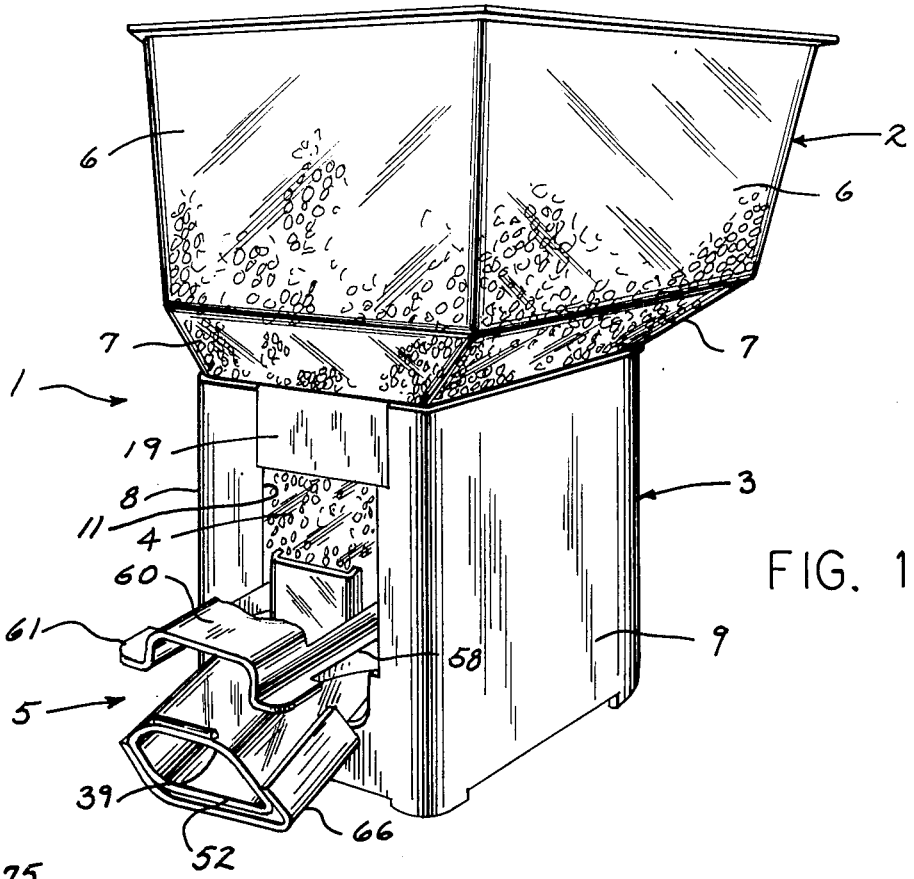
FIG. 1 is a perspective view illustrating a dispenser constructed in accordance with the principles of the present invention.

Referring now to the drawings, FIG. 1 illustrates a bulk food dispenser, generally designated by the numeral 1, constructed in accordance with the principles of the present invention. Dispenser 1 includes a transparent bin 2 supported by a housing 3, a hopper 4 contained within housing 3 and a flow regulator mechanism generally designed by the numeral 5. Bin 2 is open at its top and bottom and includes an upper rectangular portion having four upright vertical walls 6 and a lower converging section having four inwardly converging walls 7. Bin 2 and hopper 4 are both composed of a transparent material such as an acrylic plastic so that a customer in a supermarket may visually observe the contents thereof.

Figure 2:
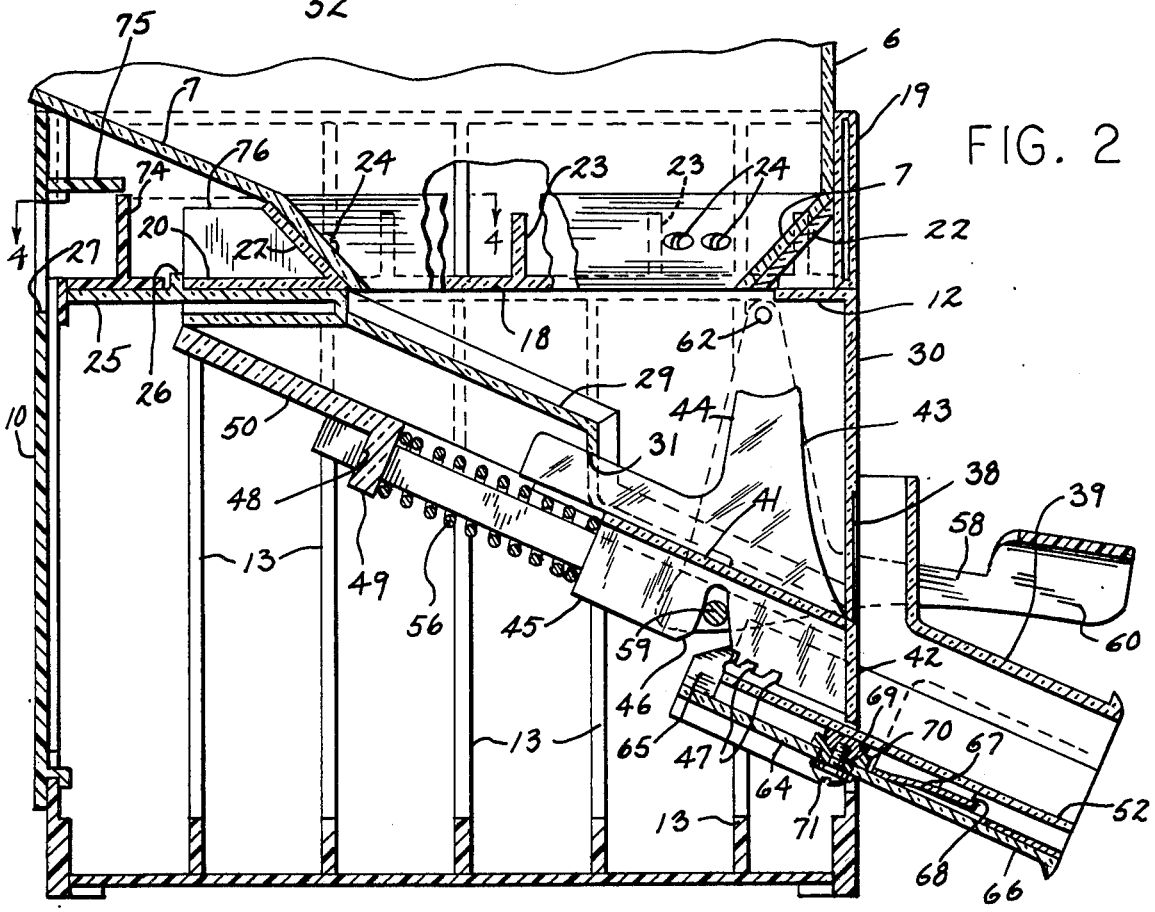
FIG. 2 is a cross-sectional side view in elevation of the dispenser shown in FIG. 1.

Housing 3 includes a front wall 8, a pair of opposite side walls 9, and a rear wall 10. Housing 3 is open at its top for ease of insertion and removal of hopper 4, and front wall 8 includes a longitudinal opening 11 through which flow regulator mechanism 5 projects. Housing 3 may be composed of any suitable material having adequate strength for supporting the components of dispenser 1 and the contents of bin 2. Preferably, housing 3 is composed of an opaque plastic material, and as shown best in FIG. 6, includes a pair of side flanges 12 (only one of which is shown in FIG. 6) that project inwardly from the inner surfaces of side walls 9 near the top thereof. As shown best in FIGS. 2, 4 and 6 flanges 12 are supported by a plurality of brackets 13 which extend from the underside thereof to bottom wall 14 of housing 3. Brackets 13 are equally spaced from one another and project inwardly from side walls 9 in an upright manner to thus also lend rigidity to side walls 9 of housing 3. Flanges 12 are further supported by a plurality of braces 15 which extend between the upper surface thereof and side walls 9. As with brackets 13, braces 15 project inwardly from side walls 9 in an upright manner. Braces 15 also include an inwardly extending slot 16 formed therein for slidably receiving a retaining a collar 17.

As shown best in FIG. 3, collar 17 includes a flat rectangular base 18 having an upright front wall 19 for receiving a label or other indicia indicating the contents of bin 2. An integral tab 20 projects rearwardly from base 18 and cooperates with a catch mechanism on hopper 4, as will hereinafter be described, for retaining collar 17 in place. Four slots 21 are formed in each side of base 18. Slots 21 cooperate with braces 15 and the catch mechanism on hopper 4 to lock collar 17 and bin 2 in place, as will hereinafter be described. Collar 17 also includes a rectangular frame 22 the surfaces of which are inclined toward the central opening of collar 17. Frame 22 is supported on base 18 by a plurality of triangular shaped brackets 23 disposed adjacent each slot 21 in base 18. Another bracket 76 extends between frame 22 and tab 20 to lend added support and rigidity to the structure. As seen best in FIG. 2, the inclination of frame 22 corresponds to the inclination of the lower ends of walls 7 of bin 2. Collar 17 may be removably attached to bin 2 by means of a plurality of screws 24 or other fastener devices.

Referring now to FIGS. 4 and 5, collar 17 and bin 2 are locked in place on housing 3 by first positioning slots 21 over and in alignment with braces 15. Collar 17 is then moved downwardly until base 18 is in alignment with slots 16 in braces 15. Collar 17 is then slid toward the front of housing 3 so that, as shown in FIG. 4, braces 15 overlap the edges of base 18 and prevent the removal of collar 17. At the same time, a catch mechanism on hopper 4 locks collar 17 in place. The catch mechanism includes a flexible tab 25 having an upright stop 26 projecting upwardly from its top surface. When collar 17 is locked in position, finger 25 is unflexed and stop 26 engages the outer edge of tab 20 to prevent any sliding movement of collar 17. However, when it is desired to remove collar 17 and bin 2, an authorized person inserts a finger through an opening 27 formed in rear wall 10 of housing 3 and depresses tab 25. Tab 25 is flexed downwardly a sufficient distance to disengage stop 26 from tab 20 so that collar 17 may be slid rearwardly i.e. to the left in FIG. 5, until slots 21 in base 18 once again are aligned with braces 15 so that collar 17 and bin 2 may be removed from housing 3. A wall 74 projects upwardly from tab 25 and functions along with spaced walls 75 to close off opening 27.

Figure 7:
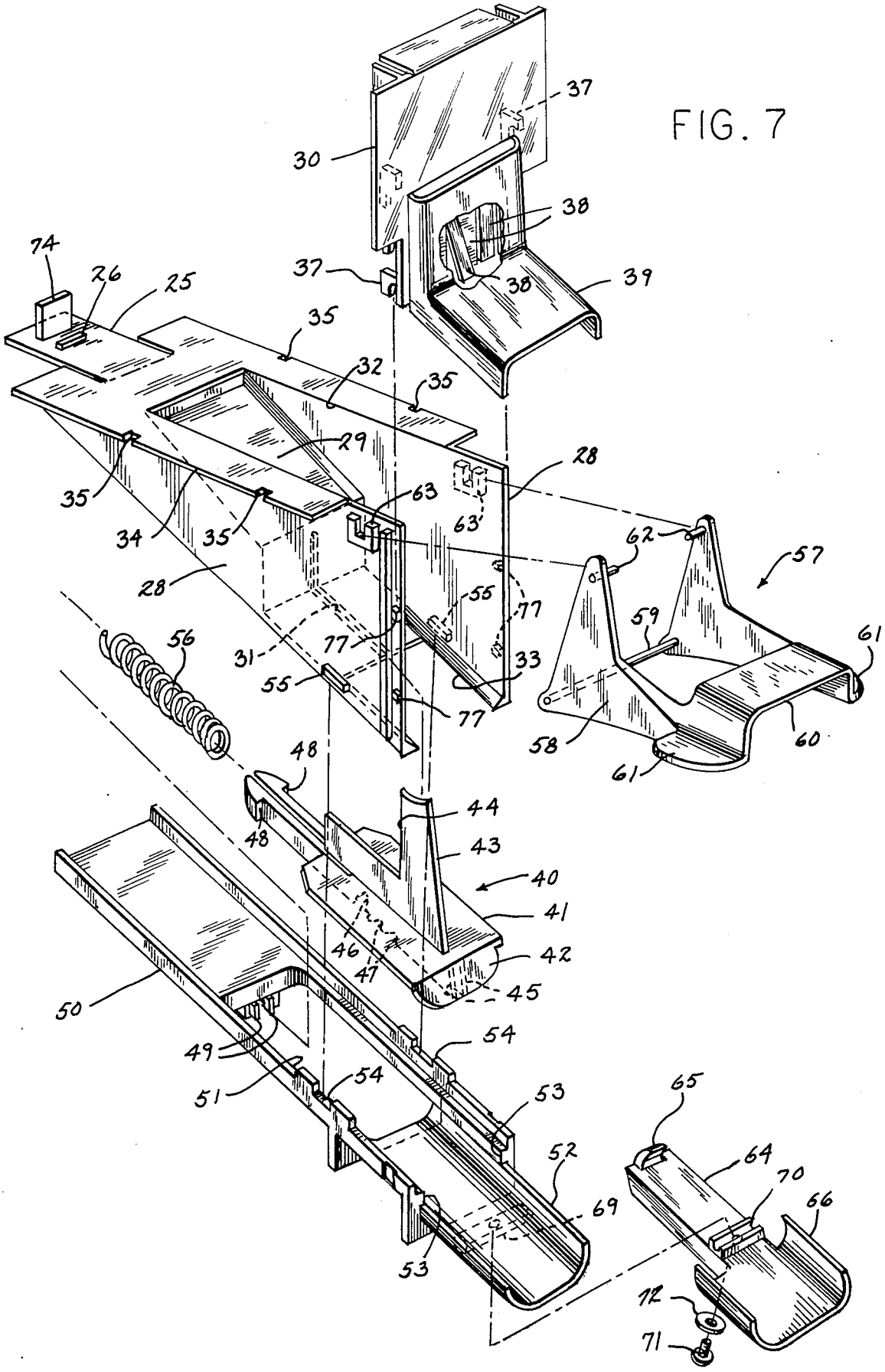
FIG. 7 is an exploded view illustrating the components of the dispenser except for the collar and transparent bin.

Referring now to FIG. 7, hopper 4 is composed of a transparent material such as acrylic plastic and includes a pair of opposite triangular shaped side walls 28 interconnected by a bottom wall 29 and a removable front wall 30. Bottom wall 29 includes inclined upper and lower portions interconnected by an inclined intermediate portion. A slot 31 is formed in the lower and intermediate portions of bottom wall 29, the function of which will hereinafter be described. Hopper 4 thus includes an inlet 32 formed at its top which communicates with the central opening in collar 17 and bin 2, and a discharge outlet 33 at its lower end defined by the lower edges of walls 28, 29 and 30. A flange 34 extends around the top edge of hopper 4 and includes a plurality of notches 35 which engage corresponding projections 36 formed on flanges 12 on side walls 9 of housing 3 (see FIG. 6) to properly locate hopper 4 within housing 3. Hopper 4 is thus supported by flanges 12, as shown best in FIG. 6.

Front wall 30 includes a plurality of hook members 37 projecting from its inner surface that are engageable with projections 77 on side walls 28 to removably mount wall 30. The lower end of wall 30 is has a plurality of flexible fingers 38 the purpose of which will hereinafter be described. Wall 30 also includes an L-shaped channel member 39 that projects from the front of housing 3 to form the top portion of a spout for dispensing the contents of bin 2 and hopper 4.

Flow regulator mechanism 5 includes a gate 40 having a planar bottom plate 41 and a front plate 42 depending at an inclined angle from the front edge of plate 41. An L-shaped upstanding plate member 43 projects upwardly through outlet 33 into the interior of hopper 4 and functions to agitate the contents thereof as gate 40 is moved between opened and closed positions. Plate 43 is slidably received within slot 31 formed in bottom wall 29 of hopper 4 and includes an abutment surface 44 which engages the intermediate portion of bottom wall 29 to limit the extent to which gate 40 may be opened. Gate 40 also includes a pair of support members 45 depending from its undersurface. Members 45 includes a first notch 46 and a plurality of second notches 47 formed therein adjacent one another. As shown best in FIG. 2, notch 46 is deeper than notches 47 the purpose of which will hereinafter be described. The rearward ends of members 45 project beyond the rear edge of plate 41 and present a pair of flexible members each having an abutment surface 48 formed thereon. The flexible rearward ends of members 45 extend through an opening formed by a pair of spaced apart stop members 49 which depend from the undersurface of a guide member 50. As shown best in FIG. 2, when gate 40 is closed abutment surfaces 48 engage stop members 49 and limit the forward or closed extent of plate 41 so that plate 42 is substantially aligned with the front wall 8 of housing 3 to close off outlet 33. Guide member 50 includes a central opening 51 and a channel-shaped portion 52 projecting forwardly therefrom to form the lower portion of a spout for dispensing the contents in hopper 4 and bin 2. Guide member 50 also includes a pair of longitudinally extending rails 53 that provide a sliding surface for the side edges of plate 41 of gate 40. Guide member 50 also includes a pair of notches 54 formed in its sides that receive a corresponding pair of projections 55 depending from the lower edges of side walls 28 for properly locating guide member 50 with respect to hopper 4. A spring 56 surrounds the flexible ends of members 45 and extends between stop members 49 and the rearward edge of plate 41. Spring 56 functions to bias gate 40 to a closed position.

As a means for moving gate 40, dispenser 1 includes an actuator arm 57 pivotally mounted to hopper 4. Arm 57 includes a pair of bell-shaped side members 58 interconnected at one end by a rod 59 and a handle 60 at its other end. Handle 60 also includes a pair of thumb tabs 61 projecting outwardly therefrom for ease and operation. The pivotal connection of arm 57 to hopper 4 is provided by a pair of pins 62 projecting inwardly from side members 58 which are journalled in a pair of U-shaped bearing members 63 disposed at the upper outside edges of side walls 29. As shown best in FIG. 2, rod 59 is received within notch 46 formed in gate 40 so that as arm 57 is pivoted gate 40 is slid between opened and closed positions.

Dispenser 1 also includes a means for latching or locking arm 57 in its non-actuated position to prevent inadvertant opening of gate 40. This latch or lock mechanism includes an arm 64 pivotally mounted to the underside of channel member 52 of guide 50. Arm 64 includes a hook 65 at its inner end which engages one of the notch 47 formed in members 45 of gate 40 to prevent movement of gate 40. The inner end of arm 64 includes a channel-shaped member or handle 66 that projects outwardly beneath member 52. Member 66 includes a leaf spring 67 which acts against a projection 68 formed on the underside of channel-member 52 to bias arm 64 to its locked position. The pivotal connection of arm 64 to guide member 50 is provided by a projection 69 on the underside of member 52 having a rounded outer surface which is engageable within a mating semi-circular surface of a channel-member 70 formed at the outer end of arm 64. A screw 71 and washer 72 affix arm 64 to guide member 50 so as to permit a rocking or pivoting movement for arm 64.

Figure 8:
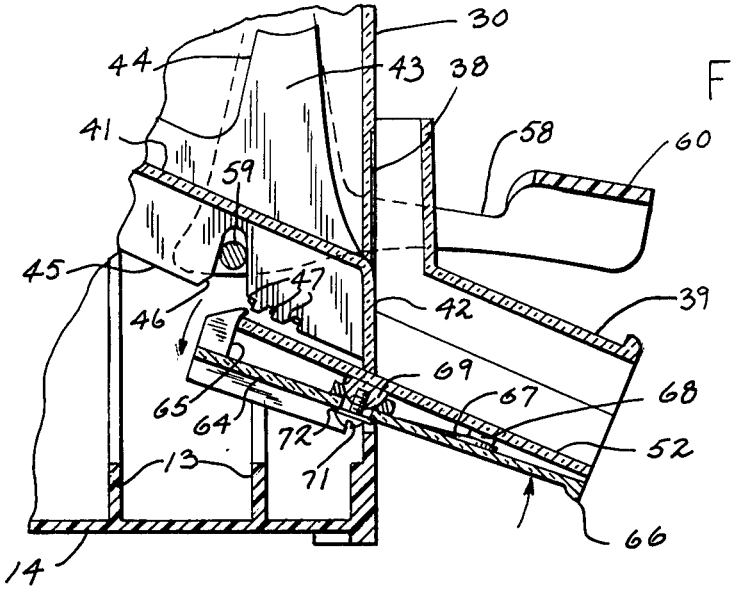
FIG. 8 is a fragmentary cross-sectional view illustrating the operation of a latch mechanism for locking the sliding gate of the dispenser.
Figure 9:
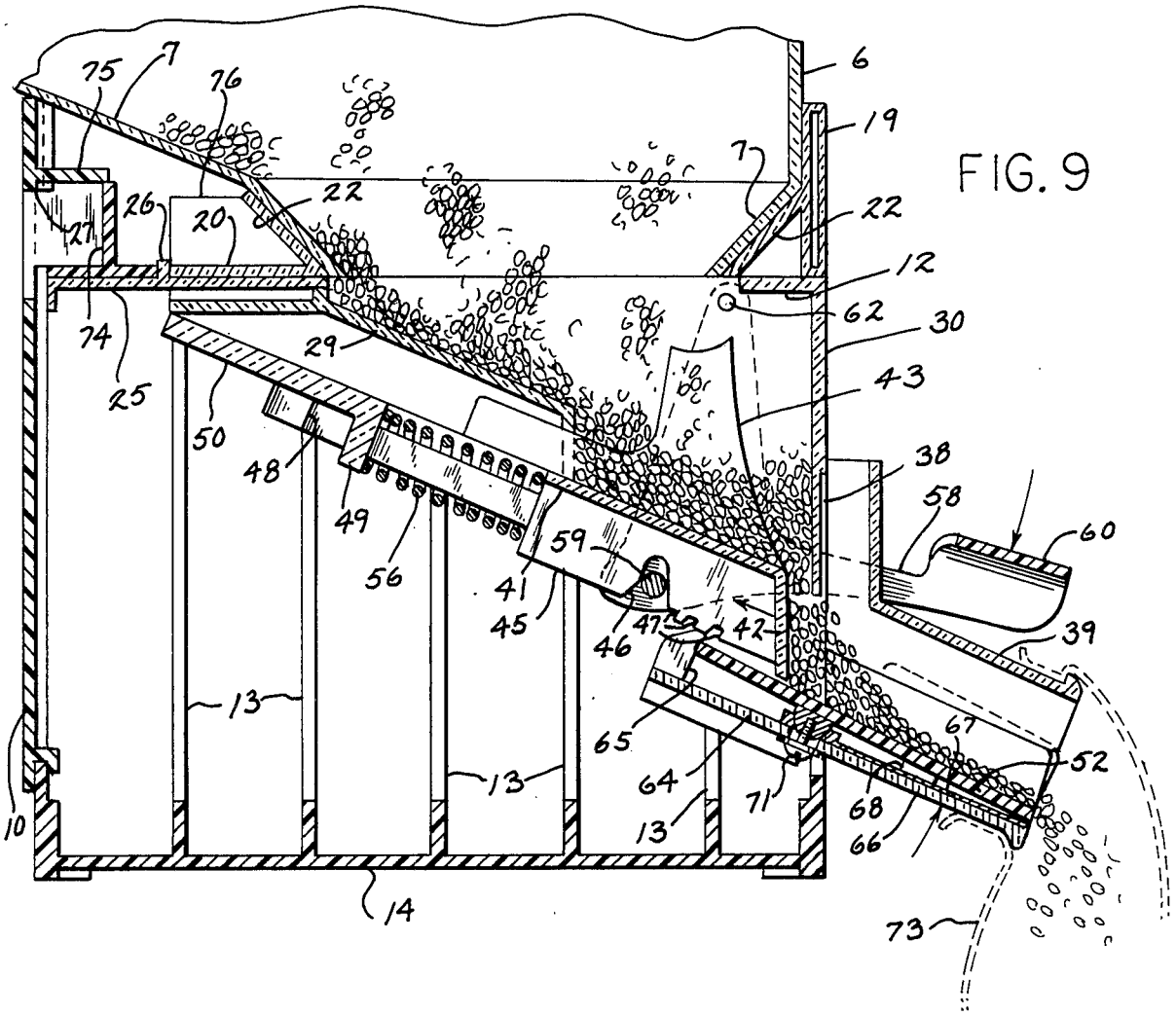
FIG. 9 is a cross-sectional side view in elevation similar to FIG. 2 illustrating the gate in its partially opened position.
Figure 10:
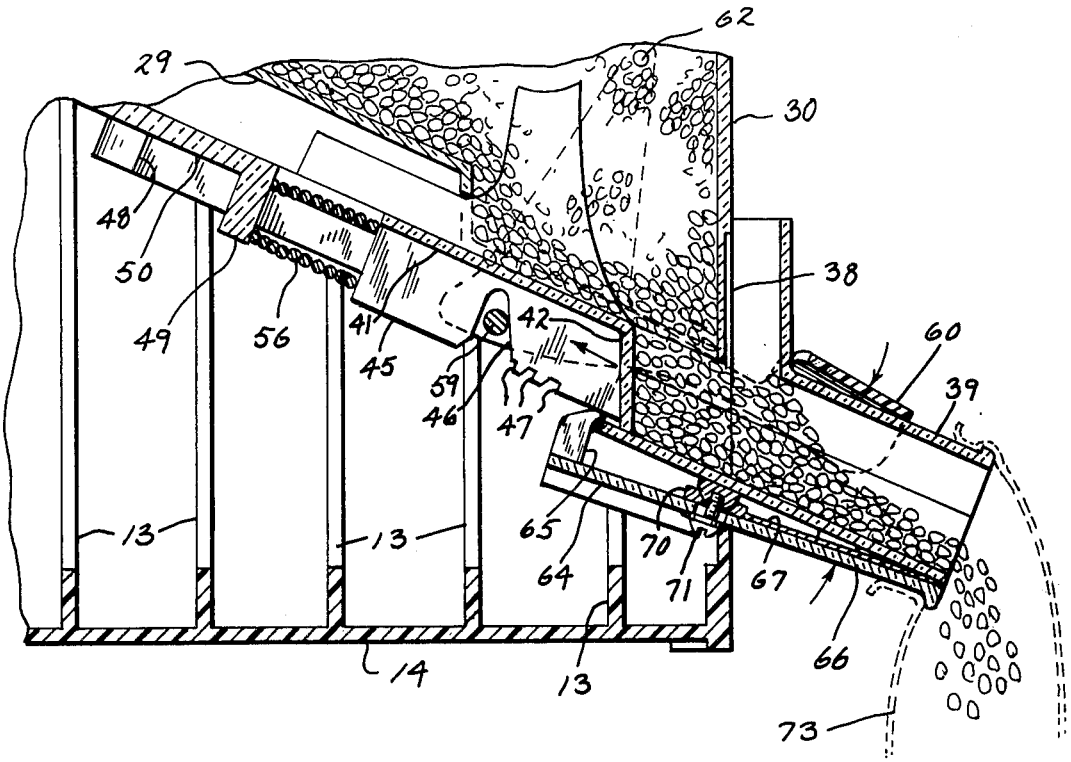
FIG. 10 is a fragmentary cross-sectional side view in elevation similar to FIG. 9 illustrating the gate in its fully opened position.
Figure 11:
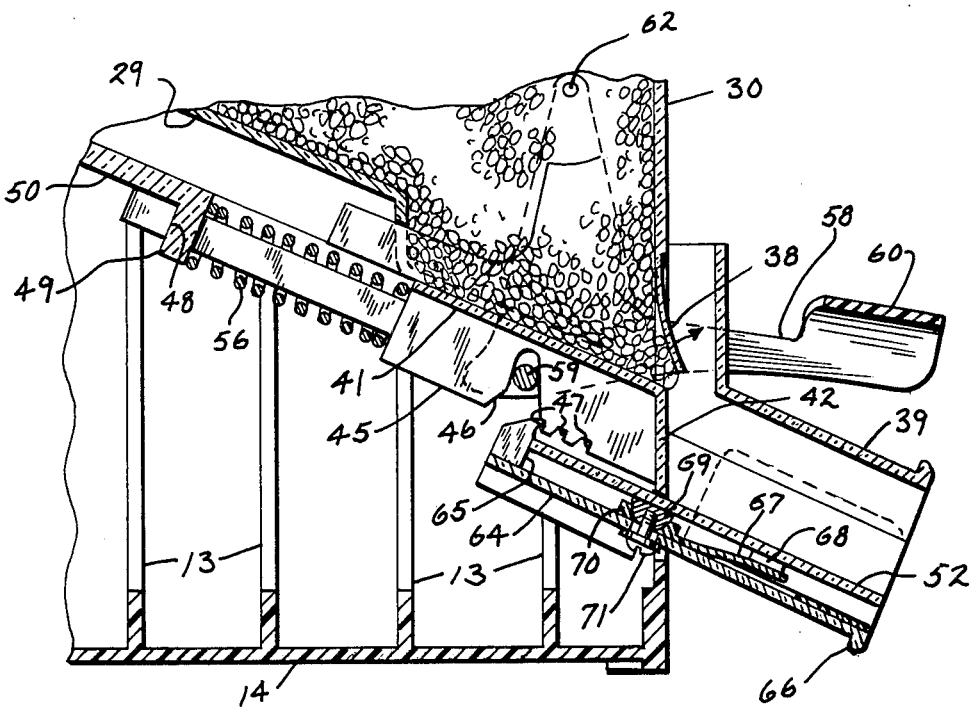
FIG. 11 is a fragmentary cross-sectional side view in elevation similar to FIG. 10 illustrating the gate in its closed position.

Referring now to FIGS. 8–11, and assuming that collar 17 and bin 2 are mounted on housing 3 as previously described, dispenser 1 is operated by first placing a bag 73 for receipt of the food around the outer end of the spout formed by members 39, 52 and 66. The operator then employs one hand to hold the bag 73 and pivot arm 64 to release hook 65 from notch 47 as shown in FIG. 8. Handle 60 is then engaged by the operator's other hand and moved downwardly so that gate 40 is slid rearwardly against the force of spring 56 to open outlet 33, as shown in FIG. 9. If the operator desires a faster flow, handle 60 is depressed further, as shown in FIG. 10, to further slide gate 40 rearwardly until abutment surface 44 engages bottom wall 29 of hopper 4. At this point, maximum discharge is provided. In order to stop the flow of the food, an operator merely releases all pressure on handle 60. The force of spring 56 will then move gate 40 to a closed position, as shown in FIG. 11, to stop the flow of food. Jamming of food at outlet 33 is prevented by the action of flexible fingers 38 on front wall 30, as shown in FIG. 11. Fingers 38 act to cushion or prevent compression of any relatively soft food contained within hopper 4. Bag 73 may then be removed and leaf spring 67 then causes hook 65 to once again engage notch 47 to prevent movement of gate 40.

A bulk food dispenser has been illustrated and described. The dispenser may be used with numerous types of bulk food and offers a user the ability to regulate the flow of food into a bag. The dispenser is tamperproof and contains a safety latch to prevent inadvertent opening. The contents of the dispenser are visually observable to a consumer, and the components of the dispenser may be easily disassembled for cleaning. Various modifications and/or substitutions of the specific components described herein may be made without departing from the scope of the invention. For example, various types of material may be employed for constructing the components of the dispenser.

Various modes of carrying out the invention are contemplated as being within the scope of the following claims particularly pointing out and distinctly claiming the subject matter which is regarded as the invention.

I claim:

1. A dispenser for dispensing bulk food, comprising:

a food-receiving hopper having an inlet at its top and an outlet at it bottom, said hopper including a pair of opposite upright side walls, a bottom wall interconnecting said side walls, said bottom wall being inclined downwardly toward said outlet, a front wall removably mounted on said side walls, and an outwardly projecting mounting flange disposed at the upper edges of said side walls;

a housing having a support flange engaging the mounting flange of said hopper to support said hopper;

an adjustable gate slidably mounted between a first position closing off said outlet and a second position opening said outlet to regulate the discharge of food by gravity therethrough, said gate includes a rod-receiving notch formed therein, a planar plate member, and an upstanding agitator member projecting in an upright manner from said plate member through said outlet into said hopper for agitating the contents thereof as said gate is moved between said positions; and actuator means for moving said gate between said positions, said actuator means includes a handle projecting from said housing having a pair of integral spaced apart side members each pivotally mounted to one of the side walls of said hopper and a rod interconnecting said side members spaced downwardly from said pivot connections and receivable within said notch in said gate.

2. The dispenser of claim 1, wherein said adjustable gate is biased to its closed position.

3. The dispenser of claim 1, further including a food-receiving bin positioned above said hopper having an outlet communicating with the inlet of said hopper, and said housing supporting both said bin and hopper.

4. The dispenser of claim 3, further including catch means for releasably securing said bin to said housing.

5. The dispenser of claim 4, wherein said catch means includes a mounting collar affixed to said bin adjacent its outlet, and means for locking said collar to said housing.

6. The dispenser of claim 4, wherein said bin and hopper are composed of a transparent material.

7. The dispenser of claim 1, wherein said upstanding agitator member includes an abutment surface engagement with said hopper to limit the movement of said gate to said second position.

8. The dispenser of claim 1, further including a guide member for guiding said gate between said positions, said guide member includes a pair of opposite side rails for slidably supporting said planar plate member and a spout portion disposed beneath said outlet and projecting from said housing.

9. The dispenser of claim 8, wherein said gate includes a resilient member having an abutment surface, and said guide member includes a stop member engageable by said abutment surface to hold said gate in said first position.

10. The dispenser of claim 1, further including latch means movable between a locked position preventing the opening of said outlet and an unlocked position permitting the opening of said outlet.

11. The dispenser of claim 10, wherein said latch means includes an arm having hook means at one end for engagement with said gate.

12. A dispenser for dispensing bulk food, comprising:

a food-receiving hopper having an inlet at its top and an outlet at its bottom, said hopper including a pair of opposite upright side walls, a bottom wall interconnecting said side walls, said bottom wall being inclined downwardly toward said outlet, a front wall removably mounted on said side walls, and an outwardly projecting mounting flange disposed at the upper edges of said side walls;

a housing having a support flange engaging the mounting flange of said hopper to support said hopper;

an adjustable gate slidably mounted between a first position closing off said outlet and a second position opening said outlet to regulate the discharge of food by gravity therethrough, said gate includes a rod-receiving notch formed therein, and a planar plate member; and actuator means for moving said gate between said positions, said actuator means includes a handle projecting from said housing having a pair of integral spaced apart side members each pivotally mounted to one of the side walls of said hopper and a rod interconnecting said side members spaced downwardly from said pivot connections and receivable within said notch in said gate.

* * * * *